US005662559A

United States Patent [19]

Vasquez

[11] Patent Number: 5,662,559

[45] Date of Patent: Sep. 2, 1997

[54] BICYCLE SIDE-SUSPENSION SYSTEM

[76] Inventor: Oscar Vasquez, 1430 SE. Bayshore Dr. #107, Miami, Fla. 33131

[21] Appl. No.: 570,748

[22] Filed: Dec. 12, 1995

[51] Int. Cl.[6] ..... A63B 21/00; G09B 9/04

[52] U.S. Cl. ..... 482/61; 434/61

[58] Field of Search ..... 482/61, 57–65, 482/89, 14, 23; 434/61, 247

[56] References Cited

U.S. PATENT DOCUMENTS

| | | | |
|---|---|---|---|
| 4,082,265 | 4/1978 | Berkes | 482/61 |
| 4,415,152 | 11/1983 | Smith | 482/61 |
| 4,580,983 | 4/1986 | Cassini et al. | 482/61 |
| 4,925,183 | 5/1990 | Kim | 482/61 |
| 4,932,651 | 6/1990 | Defaux | 482/61 |

FOREIGN PATENT DOCUMENTS

| | | | |
|---|---|---|---|
| 2403090 | 5/1979 | France | 272/73.1 |

*Primary Examiner*—Stephen R. Crow

[57] ABSTRACT

A bicycle side-suspension system for maintaining the bicycle in a generally upright position on a roller type training device while still allowing some movement and tilting of the bicycle to simulate outdoor normal riding conditions. The support system includes a single tube adjustably connected within a exercise room in a side vertical position fitting all rooms and ceilings, with suitable mechanism being provided for easily connecting the side-suspension device to the bicycle to effect such support function. The side-suspension system permits a range of lateral movements stretching across the surface of the rollers, for example, as it is being ridden on the roller type training device while still providing substantial upright support for the bicycle.

1 Claim, 3 Drawing Sheets

BICYCLE SIDE-SUSPENSION SYSTEM

FIELD OF THE INVENTION

This invention relates to bicycles, specifically to a system for supporting a bicycle on a roller type training device allowing free-standing and sideways action of the bicycle as it is ridden on the training device.

BACKGROUND OF THE INVENTION

A way to provide alternative means of home exercise is much needed. For example, it is increasingly deskable to have home gear immediately available without any need to go outdoors. Specific examples include homes where users can have the same outdoor feeling as soon as they use the bicycle side-suspension system.

It would be ideal to have the same riding experience at home. However a problem arises in that the standard set of rollers are designed to stand freely on a frame, limiting its use to riders with experience. Originally bicycle supporting devices made it difficult to enjoy the same outdoor sensation of steering and shifting gears at home. This problem has been partially solved by the implementation of support mechanisms, but these had and still have significant problems.

DESCRIPTION OF THE PRIOR ART

The supporting system in U.S. Pat. No. 4,082,265 to Berkes, 1978 Apr. 4, had a limited controlled amount of leaning action of the bicycle as it is ridden, and therefore only restricted simulation of outdoor riding conditions.

The bicycle supporting device in U.S. Pat. No. 4,580,983 to Cassini, 1986 Apr. 8, had a complex device for holding a bicycle stationary. However, the means associated with the fork device for holding the bicycle from the rear allow only limited deviations from the vertical, and the bicycle is at risk of running off of the rollers to the harm of the rider.

The means to restrain the bicycle laterally in U.S. Pat. No. 4,415,152 to Smith, 1983 Nov. 15, discloses the use of a pair of equal length flexible substantially non-stretchable restraint elements connected between opposite ends of a clamp plate and a adjustable arms. However, the restraining elements comprising a pair of chains limits the device for holding a bicycle upright while stationary.

The French Pat. No. 2403 090 to Garaud, 1977 Jun. 6, discloses the use of a fixed element attached to the time of the bicycle near the seat level. The column provided with an arm adjust for height and used to clamp to saddle. However, the arm does not allow to stretch across the surface of the rollers.

SUMMARY

It is an object of this invention to provide a bicycle side-suspension system which effectively supports a bicycle in a upright position on the conventional roller type device while still permitting unrestricted lateral movement of the bicycle simulating outdoor riding conditions. Such supporting system helps less experience riders in learning how to use the training device, particularly in regards to balancing and steering.

Another object of the invention is to provide a much simple device for supporting a bicycle stationary without the risk of falling off the rollers.

An additional objective of the invention is to provide a shock absorber tube with an internal resilient spring which allows a range of lateral movements, stretching across the surface of the rollers, therefore offering the rider the same outdoor sensation of steering and shifting gears. An objective further still is to provide an extra roller drum and a belt located near the front drum to allow beginner and children to pedal without a helping hand or fear of falling.

Another objective of the invention is to provide a new bicycle frame custom designed for children to use in conjunction with the side-suspension system and rollers.

The bicycle side-suspension system permits anyone to practice riding at first with the help of a partner holding the handle bars for only a few seconds until rider is able to obtain body control.

The physical benefits thereafter are tremendous.

All of the above features and objectives are achieved in the invention with great simplicity of construction at affordable prices.

Other objectives, advantages and the nature of the invention will become apparent during the course of the following detailed description which is given as exemplary and non-limiting embodiments of the invention without the intent of limiting the spirit and scope of the same.

DESCRIPTION OF THE PREFERRED EMBODIMENTS

Figure 1:
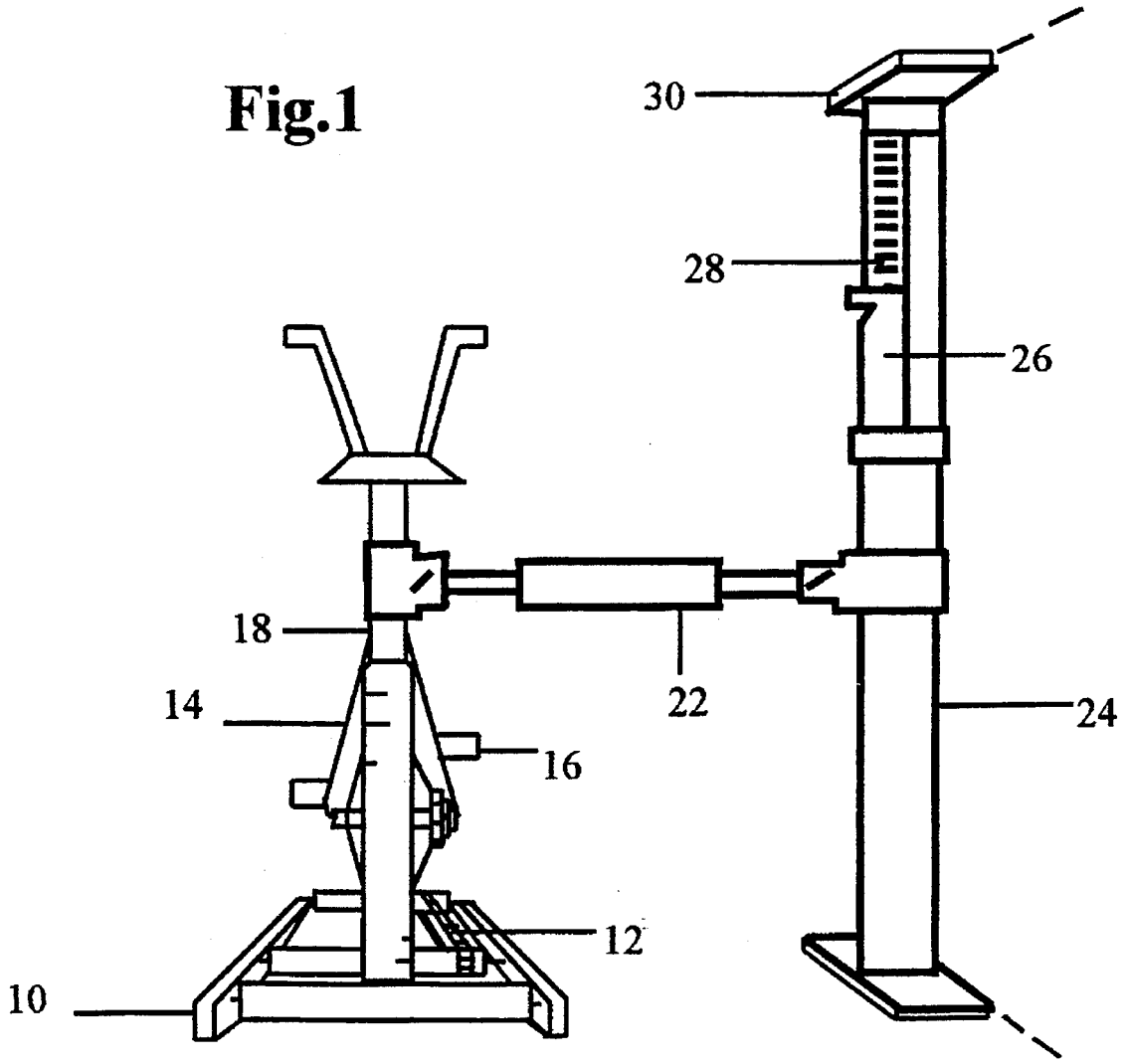
FIG. 1 is a rear perspective view of the bicycle side-suspension system.

Referring now to FIG. 1 a standard roller device 10, including means for interconnecting drums such as belt 12, establishing motion with a bicycle 14, through the pedal generally indicated as 16. Connection between supporting tube 24, and bicycle saddle post 18 is generated by appropriate connection of suspension device 22 attached to tube 24. The roller device 10, generates a rotating action to bicycle 14. Bicycle stability is accomplished by supporting tube system connected to side-suspension device. In general tube 24 extends the objective of roller 10, providing the same outdoor bike riding experience to user at home. Supporting tube 24 includes a handle 26, a pawl 28 extending rubber end pads 30 makes contact with floor and ceiling locking tube securely.

Figure 2:
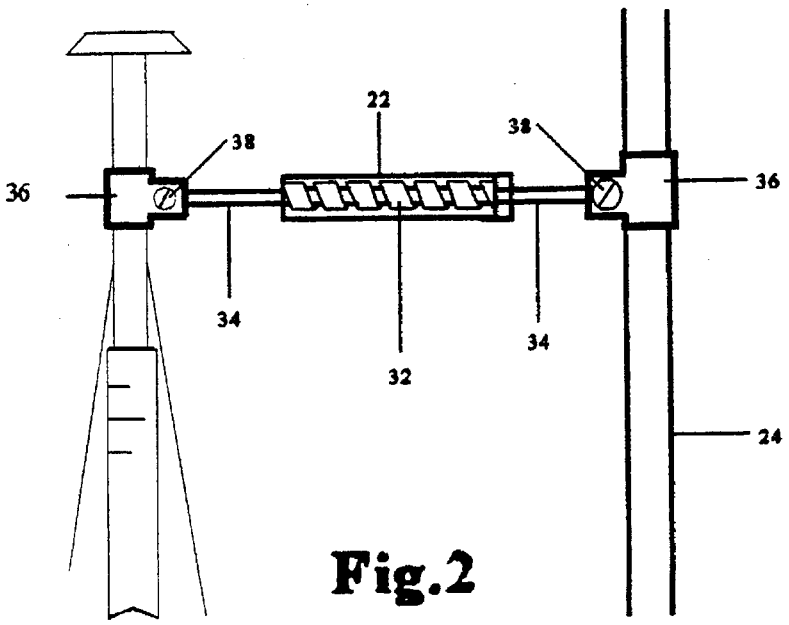
FIG. 2 is a side view of the connecting arrangement for connecting the bicycle side-suspension system to the bicycle.

Referring now to FIG. 2 a safe and simplified means to restrain the bicycle laterally within the boundaries of the roller device 10 and to limit its tilting are provided. Such means includes a bicycle side-suspension device connecting arrangement 22 extending to an elevation substantially even with the seat of a full size bicycle. The side-suspension device 22 is suitably connected on the supporting robe 24 and may be rendered vertically adjustable, if desired.

A pair of relatively short side-suspension restraint rods 34 project from the side of the supporting robe 24 and are held in brackets 36 having locking set screws 38, whereby the two rods 34 can be horizontally adjusted and locked on the supporting robe 24 to properly accommodate bicycles of different heights. Restraint rod 34 of equal length is attached to the forward end of the side-suspension device connecting arrangement 22, as by locking screw 38, and have its end attached to the frame of the bicycle saddle post 18 near and under its seat.

The side-suspension device 22 has a internal shock spring 32 to enable realistic steering and tilting of the bicycle for training purposes but limit tilting within safe limits without any effects on the bicycle or rider. The resilient spring, which is enclosed within a robe, extends allowing a range of lateral movements stretching across the surface of the rollers As a further safety and restraint, supporting robe 24, is positioned adjacent to the roller device and near and midway between the rear two drums of the roller device and parallel to the bicycle saddle post. The supporting robe 24 includes robber end pads 30 which are attached to its ends, a handle and a pawl locks supporting robe 24 securely to the floor and ceding. The supporting robe 24 prevents steering the bicycle off the moving roller device 10.

Figure 3:
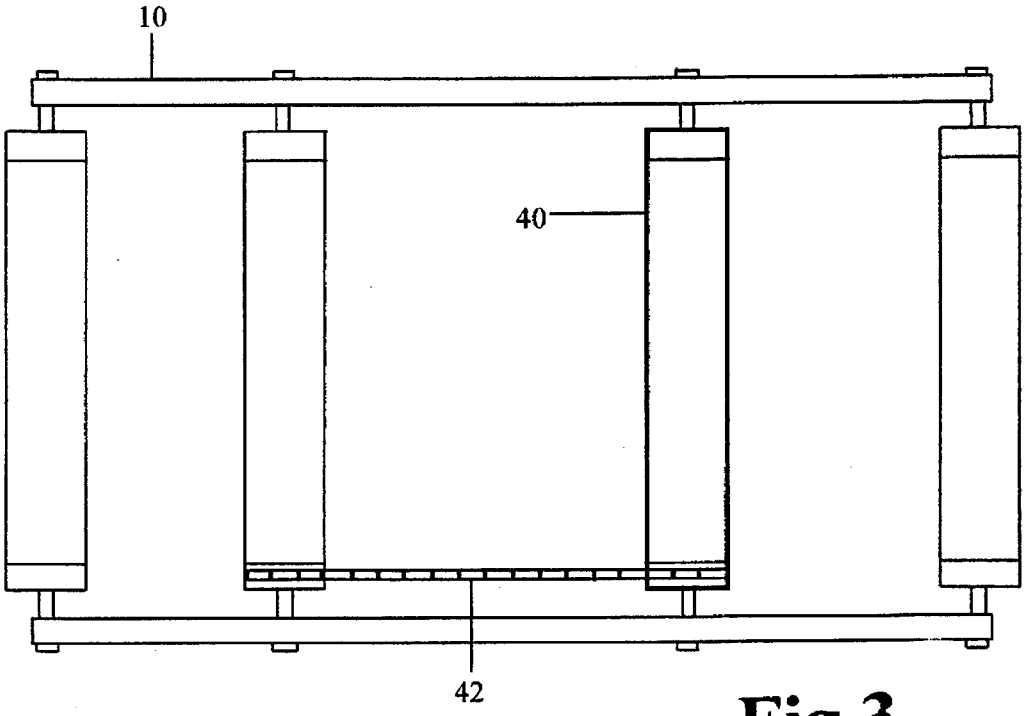
FIG. 3 is a plan view of extra drum and belt for allowing children to pedal without a helping hand.

Referring now to FIG. 3 the drums of roller device 10, includes a drum 40 and a belt 42 allowing children to use roller device indoors. The addition of a drum and a belt can provide excellent safe rider training and exercise for users who do not wish to go outdoors for an actual bicycle ride for various masons. At the same time, the device permits the use of the bicycle to teach children to ride within a safe environment.

With the new belt and dram added to the device, a kid can place his or her bike on the roller device 10. Thus, the invention has dual utility as an exercising apparatus, and this feature is not provided by any prior art mechanism.

Compared to the prior art, the invention is simpler in construction, more compact, safer and more realistic in simulating a bicycle ride over a typical roadway.

Figure 4:
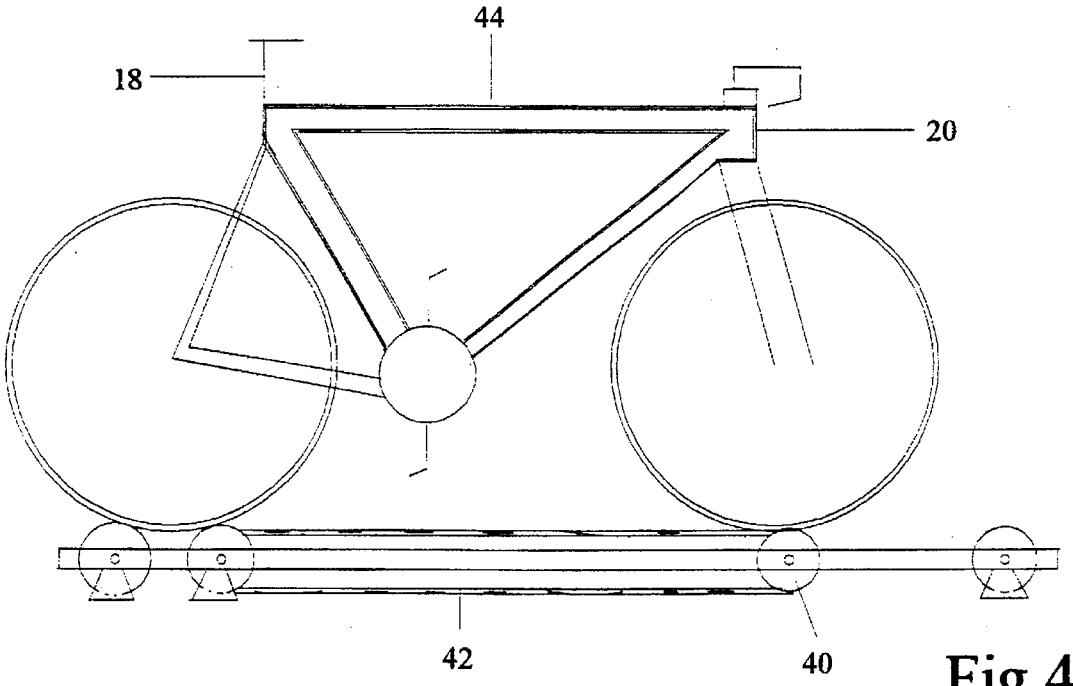
FIG. 4 is a side view of a new bicycle frame custom designed for children to use in conjunction with side-suspension system and rollers..

Referring now to FIG. 4 a new bicycle frame will be described. The bicycle frame 44 interfacing between the roller device and the reader of roller drum 40 and belt 42 providing usage of roller device to children in conjunction with supporting tube 24 and bicycle side-suspension system 22 provided.

It should be appreciated that the above described invention is not limited to the specific mode or function of operation shown. For example, the invention is responsive to more than one tube from a roller device 10. Tube 24 can be adapted to any roller device or any bicycle to provide first time users easy steering control and on-roll stability.

To accommodate a different exercise plan, tube 24 need only be place on both sides of the saddle post 18 and also on both sides of the bicycle frame front-end stem 20. Advanced suspension technology devices such as 22 to control tension and/or compression can be utilized and other modifications can be made to the application and arrangements of the elements without departing from the spirit of the invention as expressed in the attached claims.

Accordingly, the scope of the invention should be determined not by the embodiments illustrated, but by the appended claims and their legal equivalents.

What is claimed is:

1. A bicycle side-suspension device for restraining a bicycle on a roller type training device comprising:

a support system having a length adjustable, vertically aligned support tube, a pair of rubber pads attached to the ends of said tube, a handle and a pawl lock means mounted on said tube for adjusting the tube length and frictionally affixing the rubber pads to the ceiling and floor of an exercise room, a horizontally aligned support bracket connected to said tube at a proximal end, means for adjusting and locking said bracket at a desired elevation on said tube, a distal end of said support bracket including means for removably attaching the frame of a bicycle, and said bracket including an internal spring which permits lateral movement and tilting of the bicycle across the roller type training device during use.

* * * * *